US009269302B2

(12) United States Patent
Gu et al.

(10) Patent No.: US 9,269,302 B2
(45) Date of Patent: Feb. 23, 2016

(54) VOLTAGE COMPENSABLE OLED DISPLAY DEVICE

(71) Applicants: Shanghai Tianma Micro-Electronics Co., Ltd., Shanghai (CN); Tianma Micro-Electronics Co., Ltd., Shenzhen (CN)

(72) Inventors: Hanyu Gu, Shanghai (CN); Chang-ho Tseng, Shanghai (CN)

(73) Assignees: Shanghai Tianma Micro-Electronics Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 68 days.

(21) Appl. No.: 14/077,188

(22) Filed: Nov. 11, 2013

(65) Prior Publication Data

US 2014/0368416 A1 Dec. 18, 2014

(30) Foreign Application Priority Data

Jun. 18, 2013 (CN) ..... 2013 1 0242553

(51) Int. Cl.
*G09G 3/30* (2006.01)
*G09G 3/32* (2006.01)

(52) U.S. Cl.
CPC ..... *G09G 3/3258* (2013.01); *G09G 3/3233* (2013.01); *G09G 2300/0426* (2013.01); *G09G 2320/0223* (2013.01); *G09G 2320/0233* (2013.01); *G09G 2330/02* (2013.01)

(58) Field of Classification Search
CPC ..... G09G 3/30; G09G 3/36; G09G 3/32; G09G 3/34; G09G 5/00; G06F 3/038
USPC ..... 345/76, 78, 98, 100
See application file for complete search history.

(56) References Cited

U.S. PATENT DOCUMENTS

| | | | | |
|---|---|---|---|---|
| 2001/0043168 | A1* | 11/2001 | Koyama et al. | 345/52 |
| 2005/0117410 | A1* | 6/2005 | Shin | 365/189.09 |
| 2007/0182672 | A1 | 8/2007 | Hoppenbrouwers et al. | |
| 2010/0141630 | A1 | 6/2010 | Kimura | |
| 2010/0245324 | A1 | 9/2010 | Minami et al. | |
| 2013/0106676 | A1* | 5/2013 | Ono et al. | 345/76 |

FOREIGN PATENT DOCUMENTS

| | | | |
|---|---|---|---|
| CN | 1658262 | A | 8/2005 |
| CN | 1930603 | A | 3/2007 |
| CN | 102834858 | A | 12/2012 |
| JP | 2008046393 | A | 2/2008 |

OTHER PUBLICATIONS

Extended European Search Report from corresponding European Application No. 13194052.0, mailed on May 9, 2014, 15 pages total.
Office Action as issued in corresponding Chinese Application No. 201310242553.3, dated Jul. 24, 2015, and English-language summary thereof.

* cited by examiner

*Primary Examiner* — Pegeman Karimi
(74) *Attorney, Agent, or Firm* — Alston & Bird LLP

(57) ABSTRACT

An OLED display device includes multiple pixel units arranged in a matrix and a power supply driver chip located at one side of the multiple pixel units. The power supply driver chip is configured to supply input voltages to the multiple pixel units. The power supply driver chip provides the input voltages to the multiple pixel units through a plurality of input paths. The input paths are associated with input points, each of the input points corresponds to a pixel unit at a different location. The power supply driver chip compensates the input voltages to ensure that all of the pixel units at different locations may have an approximately equal input voltage, enabling the entire display region of the OLED display device to display with a uniform brightness and improving the display performance.

9 Claims, 7 Drawing Sheets

VOLTAGE COMPENSABLE OLED DISPLAY DEVICE

CROSS-REFERENCES TO RELATED APPLICATIONS

This application claims the benefit of priority to Chinese Patent Application No. 201310242553.3, entitled "OLED DISPLAY DEVICE", filed on Jun. 18, 2013 with the State Intellectual Property Office of People's Republic of China, the contents of which is incorporated herein by reference in its entirety.

FIELD OF THE INVENTION

The invention relates to display technology, and in particular to an Organic Light-Emitting Diode (OLED) display device and a method for detecting and compensating an output voltage of the OLED display device.

BACKGROUND OF THE INVENTION

OLED display device, which is also known as organic electroluminescence display, has the characteristics of self-luminescence and adopts a very thin organic material coating and a glass substrate. The organic material glows when the current flows through it. Moreover, the OLED display device has a large visual angle and is significant power saving. Therefore, the OLED display device has incomparable advantages over many traditional display devices, such as liquid crystal display devices.

FIG. 1 shows a schematic diagram of an equivalent circuit for a pixel unit in an OLED display device, and FIG. 2 shows a schematic diagram of an OLED display device in the prior art.

As shown in FIG. 1, in one pixel unit, a scan signal "scan" controls the on or off state of a thin film transistor M1. In the case that M1 is in the on state, a data signal "data" is transferred to the gate electrode of a thin film transistor M2 to control the current in M2. The current flows from the power supply signal PVDD to the low potential end PVEE through the thin film transistor M2, and the organic light-emitting diode "oled" emits light in response to the current and implement the display. The organic light-emitting diode "oled" is a current-driven element, in which the current flowing through the organic light-emitting diode "oled" may be calculated from the following formula:

$$I_{oled}=\tfrac{1}{2}\times\mu\times C_{ox}\times W/L\times(PVDD-V_{data}-V_{th})^2$$

μ: the mobility of the active layer;

$C_{ox}$: the capacitance of the capacitor formed by the gate electrode and the active layer;

W: the width of the channel in the organic light-emitting diode;

L: the length of the channel in the organic light-emitting diode;

$V_{data}$: the voltage of the data signal;

$V_{th}$: the threshold voltage of the organic light-emitting diode; and

PVDD: the voltage of the power supply signal.

Once the size of the organic light-emitting diode "oled" is determined, the values of μ, $C_{ox}$, W, L and $V_{th}$ are also determined. As can be seen from the above formula, for a certain organic light-emitting diode "oled", the current flowing through the organic light-emitting diode "oled" is determined by the value of the power supply signal PVDD and the data signal $V_{data}$.

Next, reference is made to FIG. 2. In an OLED display device, multiple pixel units arranged in a matrix are disposed in a region AA, and a driver chip "Driver IC" is disposed on one side of the OLED display device and configured to provide scan signals and data signals to the multiple pixel units. A power supply driver chip "Power IC" is also provided. Generally, only one power supply driver chip is required for the OLED display device with a small panel. The driver chip "Driver IC" is disposed on the panel of the OLED display device, and the power supply driver chip "Power IC" is disposed on a flexible circuit board or a printed circuit board.

The power supply driver chip "Power IC" supplies an input voltage PVDD to the multiple pixel units through an input path P, for driving the organic light-emitting diodes to emit lights and implement the display. In the entire display region AA, input terminals of the pixel units for input the voltage PVDD are connected together. Since the OLED display device is a current-driven device and each pixel unit has a resistance, a voltage drop is generated across the pixel units from the point AA1 nearest to the power supply driver chip "Power IC" to the point AA2 farthest to the power supply driver chip "Power IC" due to the driving current. That is, the voltage at the nearest point AA1 is larger than that at the farthest point AA2.

From the nearest point AA1 to the farthest point AA2, the currents flowing through the pixel units decrease gradually from one pixel unit to another as the voltages decrease sequentially from one pixel unit to another, resulting in gradually reduced brightness from one to another portion of the OLED device. As a result, the OLED display device lacks brightness uniformly. This problem becomes more serious as the size of the OLED display device increases.

BRIEF SUMMARY OF THE INVENTION

In view of the above, embodiments of the invention provide an OLED display device to solve the problem.

According to an embodiment, an OLED display device includes multiple pixel units arranged in a matrix and a power supply driver chip located at one side of the multiple pixel units. The power supply driver chip is configured to supply input voltages to the multiple pixel units, and the power supply driver chip supplies input voltages to the multiple pixel units through a plurality of input paths. An input point of each of the input paths corresponds to a pixel unit at a different location.

In an embodiment, in the OLED display device a reference voltage is provided, and a detecting wire is associated with one of the input paths. The detecting wire is configured to transfer the voltage at the input point of the input path to a detecting point for a comparison to the reference voltage. If there is a voltage difference between the voltage at the input point and the reference voltage, the power supply driver chip supplies a compensation voltage to the input path to change the input voltage of the input path, so as to reduce the voltage difference.

DETAILED DESCRIPTION OF THE INVENTION

First Embodiment

Figure 1:
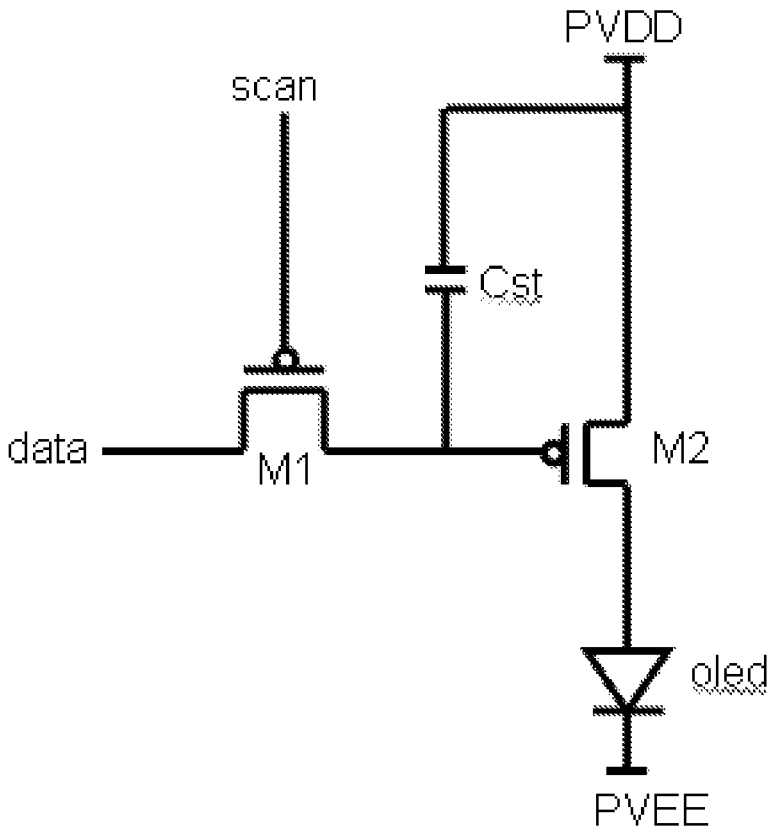
FIG. 1 shows a schematic diagram of an equivalent circuit for a pixel unit in an OLED display device.
Figure 2:
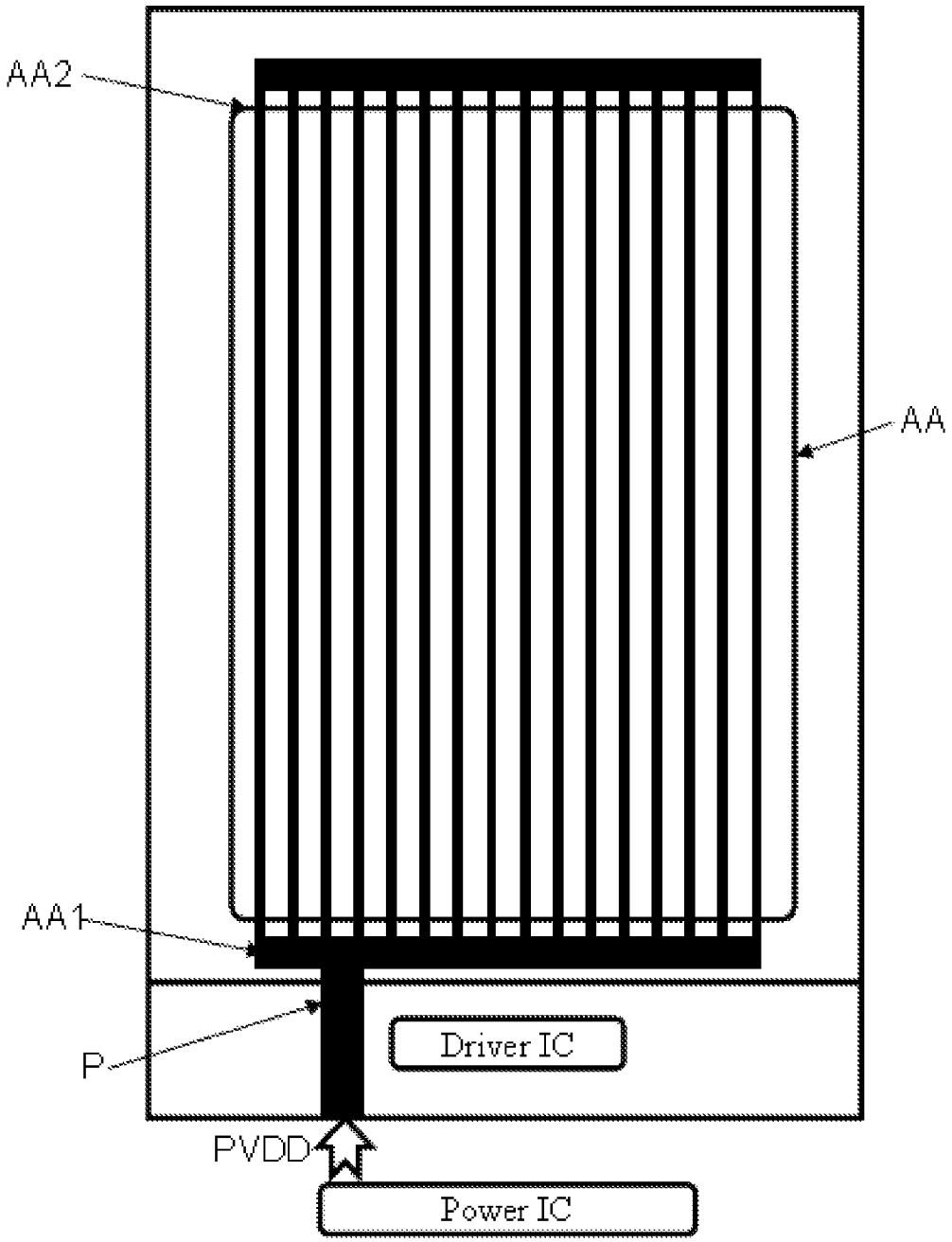
FIG. 2 shows a schematic diagram of an OLED display device in the prior art.
Figure 3:
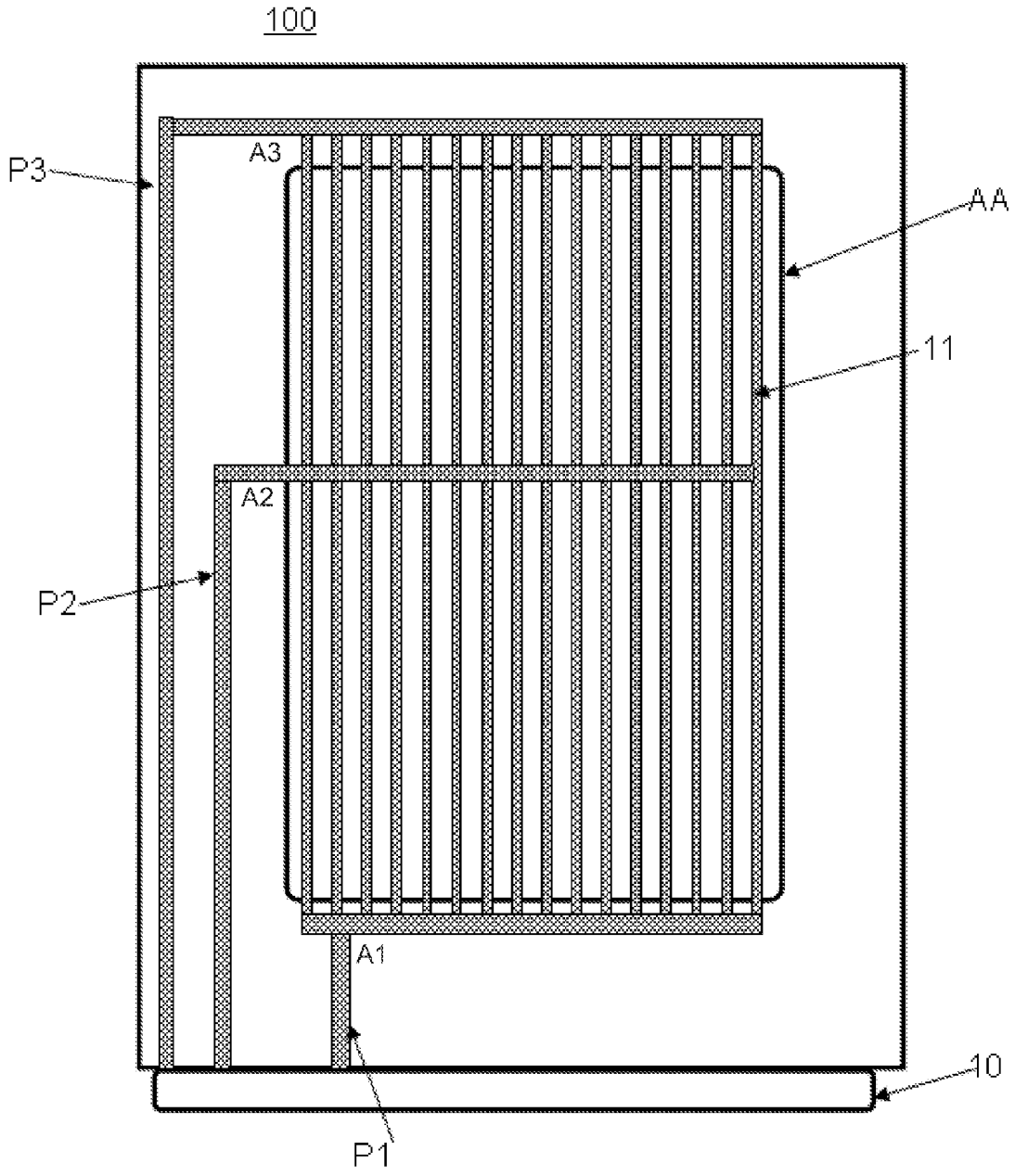
FIG. 3 is a schematic diagram of an OLED display device according to a first embodiment of the present invention.

Reference is made to FIG. 3, which is a schematic diagram of an OLED display device according to a first embodiment of the present invention. In the OLED display device 100 according to the first embodiment, multiple pixel units arranged in a matrix are disposed in a display region AA, and a power supply driver chip 10 is disposed at one side of the multiple pixel units. The power supply driver chip 10 is configured to supply an input voltage PVDD to the multiple pixel units. The power supply driver chip 10 supplies the input voltage to the multiple pixel units through three input paths P1, P2 and P3, respectively. In the first embodiment, the input terminals for the input voltage PVDD of each column of the pixel units are connected with one wire 11, and all the wires 11 are connected together outside the display region AA.

In the first embodiment, the input point A1 of the input path P1 is located at the pixel unit which is the nearest to the power supply driver chip 10, and at the input point A1 the input path and the pixel unit are connected. The input point A3 of the input path P3 is located at the pixel unit which is the farthest to the power supply driver chip 10, and the input point A2 of the input path P2 is located at the pixel unit which is in the middle of the display region AA. The input points of respective input paths are disposed on the same side of the matrix of the pixel units, and the input points of the multiple input paths P1, P2 and P3 are distributed evenly with respect to the matrix of the pixel units, i.e. the input points are spaced apart by an equal number of rows of pixel units. Furthermore, the power supply driver chip 10 supplies the same input voltage PVDD to the input paths P1, P2 and P3.

The power supply driver chip 10 supplies the input voltage PVDD to the display region AA through the three input paths P1, P2, and P3, and all of the pixel units at different locations may have an approximately equal input voltage. Therefore, the case where from the side nearest to the power supply drive chip 10 to the side farthest to the power supply drive chip 10 the voltages of the pixel units decrease sequentially from one pixel unit to another is optimized, the entire display region AA of the OLED display device may have a uniform brightness and the display performance is improved.

Second Embodiment

Figure 4:
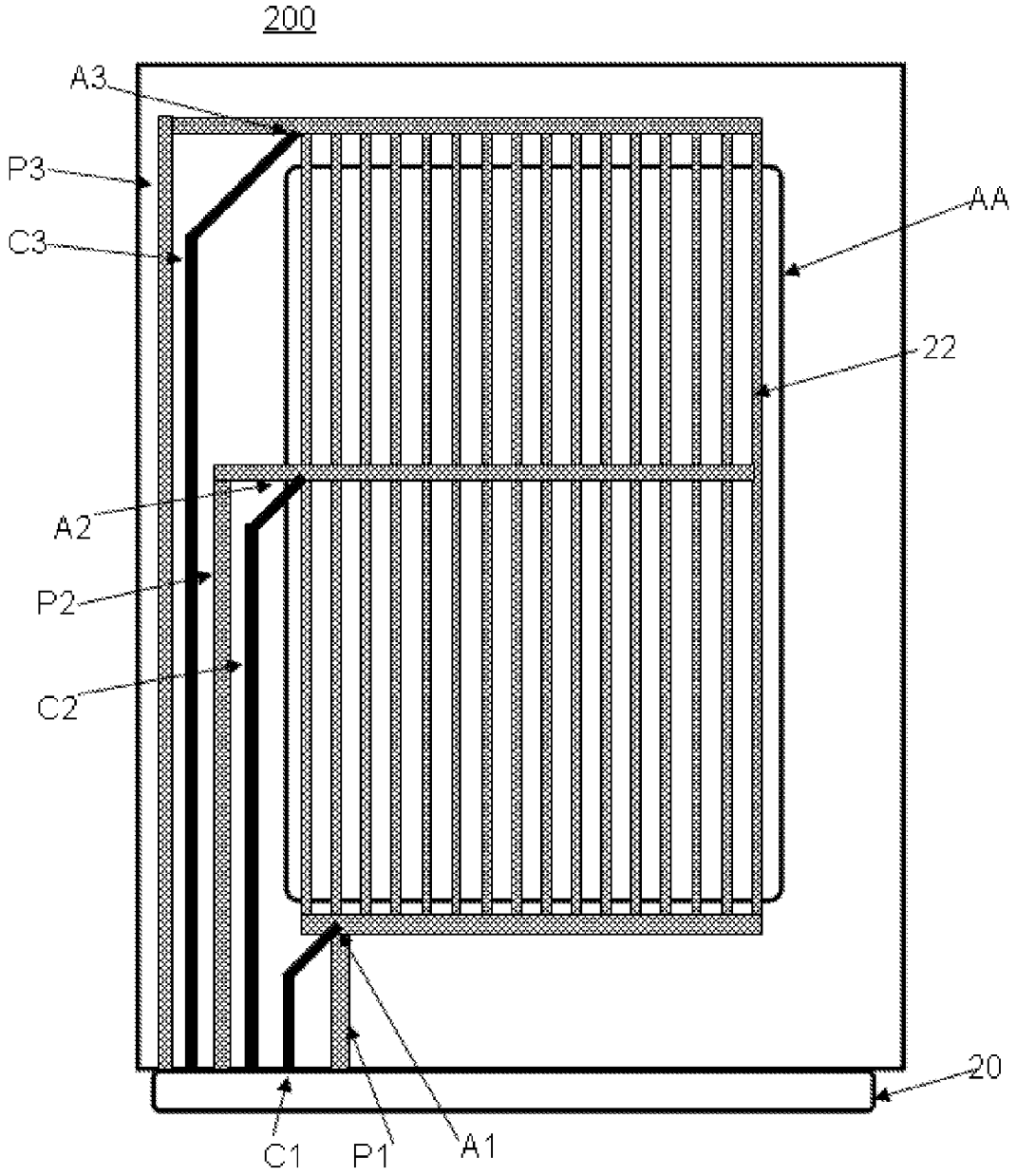
FIG. 4 is a schematic diagram of an OLED display device according to a second embodiment of the present invention.

Reference is made to FIG. 4, which is a schematic diagram of an OLED display device provided in a second embodiment. In the OLED display device 200 provided according to the second embodiment, multiple pixel units arranged in a matrix are disposed in a display region AA, and a power supply driver chip 20 is disposed at one side of the multiple pixel units. The power supply driver chip 20 supplies input voltages to the multiple pixel units through three input paths P1, P2 and P3 respectively. The power supply driver chip 20 supplies an input voltage PVDD 1 to the input path P1, an input voltage PVDD2 to the input path P2, and an input voltage PVDD3 to the input path P3. The input point A1 of the input path P1 is located at the pixel unit which is the nearest to the power supply driver chip 20; the input point A3 of the input path P3 is located at the pixel unit which is the farthest to the power supply driver chip 20; and the input point A2 of the input path P2 is located at the pixel unit which is in the middle of the display region AA. In the second embodiment, input terminals for the input voltages PVDDs of each column of the pixel units are connected with one wire 22, and all the wires 22 are connected together outside the display region AA.

As a preferable embodiment, in the OLED display device 200 according to the second embodiment, detecting wires C1, C2 and C3, corresponding to the input paths P1, P2 and P3 respectively, are provided. The respective detecting wires C1, C2 and C3 transfer the respective voltages at the input points A1, A2 and A3 of the input paths P1, P2 and P3 to a detecting point. In the second embodiment, the detecting point is located within the power supply driver chip 20. For example, the detecting wire C1 transfers the voltage at the input point A1 of the input path P1 to the detecting point located within the power supply driver chip 20.

Figure 5:
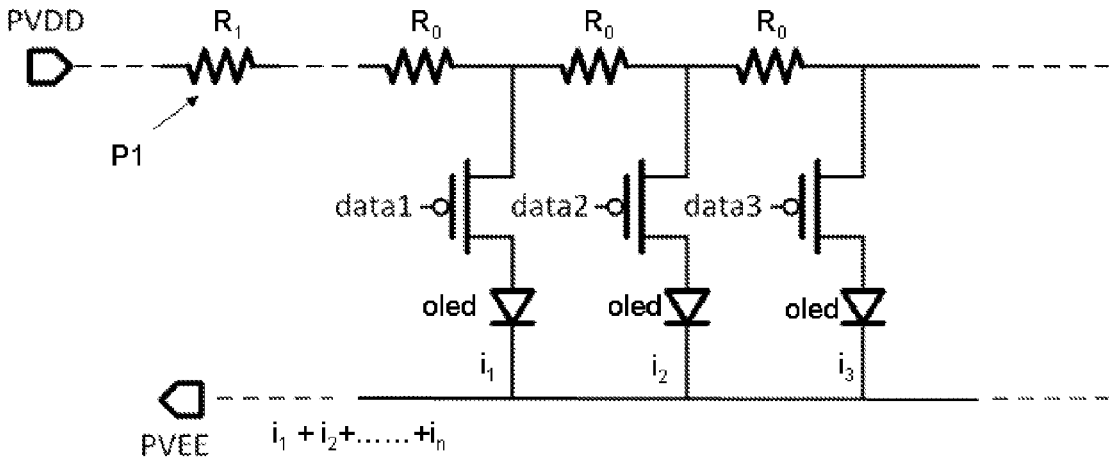
FIG. 5 is a schematic diagram of an equivalent circuit for an input path P1 and a display region AA of the second embodiment of the present invention.

Reference is made to FIG. 5, which is a schematic diagram of an equivalent circuit for the input path P1 and the display region AA. As shown in FIG. 5, multiple pixel units are connected in parallel between the input path P1 and a low voltage input terminal PVEE, and each of the pixel units is equivalent to a serial connection of a resistor $R_0$ and an organic light emitting diode "oled", in which the current of the organic light emitting diode "oled" is controlled by a data signal "data", and the cathodes of all organic light emitting diodes "oleds" are connected together to the low voltage input terminal PVEE.

The current $i_1$ flowing through a first pixel unit, the current $i_2$ flowing through a second pixel unit, the current $i_3$ flowing through a third pixel unit, . . . , and the current $i_n$ flowing through a $n^{th}$ pixel unit, decrease gradually from one to another, due to the voltage drop generated when the current flowing through each pixel unit. The total current $i_1+i_2+i_3+\ldots+i_n$ has a value generally ranging from tens of milliamperes to hundreds of milliamperes. Because the total current flowing through the input path P1 is large, and the input path P1 has a certain resistance even when it is a metal wire, assuming that the resistance of the input path P1 is $R_1$, the voltage drop of the input voltage PVDD1 in the input path P1 is $R_1\times(i_1+i_2+i_3+\ldots+i_n)$. As a result, the voltage at the input point A1 is PVDD1$-R_1\times(i_1+i_2+i_3+\ldots+i_n)$, which is the exact voltage transferred to the pixel units and is smaller than the input voltage PVDD1 supplied to the input path P1 by the power supply driver chip 20.

Because the input path P2 is longer than the input path P1, the resistance of the input path P2 is larger than the resistance R1 of the input path P1. Assuming that the resistance of the input path P2 is $R_2$ and the total current flowing through the input path P2 is $(i_1+i_2+i_3+\ldots+i_n)'$, then in the same way, the voltage drop generated from the current flowing through the input path P2 is $R_2\times(i_1+i_2+i_3+\ldots+i_n)'$, i.e., the voltage at the input point A2 is PVDD2$-R_2\times(i_1+i_2+i_3+\ldots+i_n)'$, which is also smaller than the original input voltage PVDD2. Similarly, the voltage at the input point A3 is smaller than the input voltage PVDD3.

If the input voltages PVDD1, PVDD2 and PVDD3 supplied to the input paths P1, P2 and P3 respectively by the power supply driver chip 20 are equal to each other, the voltages at the input points A1, A2 and A3 of the input paths are not equal. Furthermore, the voltage at the input point A1 is higher than that at the input point A2, and the voltage at the input point A2 is higher than that at the input point A3.

It can be seen from the above that for the pixel units in the entire display region AA of the OLED display device 200, although the input points of the input paths are disposed evenly, the voltages at the input points are different.

In the second embodiment, the respective detecting wires C1, C2 and C3 transfer the respective voltages at the input points A1, A2 and A3 of the input paths P1, P2 and P3 to a detecting point located within the power supply driver chip 20. The detecting wires C1, C2 and C3 are only used in the measurement of the voltages and the voltage drops on the detecting wires are very small and negligible. Also, the power supply driver chip 20 supplies a reference voltage P0, which is compared to the voltages at the respective input points. In the case that there is a voltage difference between the voltage at an input point of an input path and the reference voltage P0, the power supply driver chip 20 supplies a compensation voltage to the input path to change the value of the original input voltage, so as to reduce the voltage difference, i.e., to make the voltages at the input points to be equal or have the smallest possible difference.

The compensation voltage may be either a positive or a negative value. In the case that the voltage at the input point of the input path is higher than the reference voltage P0, the power supply driver chip 20 supplies a negative compensation voltage to the input path to decrease the value of the original input voltage of the input path, so as to reduce the voltage difference. In the case that the voltage at the input point of the input path is smaller than the reference voltage P0, the power supply driver chip 20 supplies a positive compensation voltage to the input path to increase the value of the original input voltage of the input path, so as to reduce the voltage difference.

For example, at a given moment in time, the power supply driver chip 20 detects that the voltage at the input point A2 of the input path P2 is higher than the reference voltage P0 and the voltage difference is +0.05V; at the same time, the power supply driver chip 20 also detects that the voltage at the input point A3 of the input path P3 is higher than the reference voltage P0 and the voltage difference is −0.03V. Then when providing voltages to the input paths in the next time period, the power supply driver chip 20 supplies a compensation voltage ΔV2 of −0.05V to the input path P2, that is, the voltage supplied to the input path P2 by the power supply driver chip 20 for the next time period is changed and is smaller than that for the last time by 0.05V; and the power supply driver chip 20 supplies a compensation voltage ΔV3 of +0.03V to the input path P3, that is, the voltage supplied to the input path P3 by the power supply driver chip 20 for the next time period is changed and is higher than that for the last time period by 0.03V. In this way, the voltage differences between the reference voltage P0 and the voltages at the input points A2 and A3 may be reduced. In the next detecting phase, the voltages at the input points will be compared with the reference voltage P0 again and will be corrected again, until the difference is within a predetermined range.

Since the OLED display device provided in the second embodiment has the function of detecting and correcting the input voltages, the voltages at the input points may be consistent or approximate. That is, for all of the pixel units in the entire display region AA, not only the input points are disposed evenly, but also the voltages at the input points are the same or about the same, which may further improve the brightness uniformity of the OLED display device.

In an embodiment, in the case where the voltage difference between the voltage at the input point and the reference voltage P0 is greater than 0.1V, the power supply driver chip 20 supplies a compensation voltage to the input path to change the original input voltage of the input path, so as to reduce the voltage difference to be smaller or equal to 0.1V. When the voltage difference between the voltage at the input point and the reference voltage is smaller than 0.1V, the display uniformity of the entire matrix of pixel units is still acceptable. However, when the voltage difference exceeds 0.1V or above, the uneven brightness of the entire matrix of pixel units is noticeable by human eyes. Therefore, when the voltage difference is larger than 0.1V, the OLED display device 200 may start the correcting function for input voltages to reduce the voltage difference to be equal to or smaller than 0.1V.

In an embodiment, the power supply driver chip 20 detects the voltages of the respective input points before the beginning or after the end of each frame scanning. This is because before the beginning or after the end of each frame scanning, in each pixel unit of the entire matrix of the pixel units, the current flowing through the organic light emitting diode "oled" is determined and the voltage drop in each pixel unit is also determined, so the voltages at the respective input points to be detected are stable at this time. In order to reduce the computation and the power consumption of the power supply driver chip 20, the voltages at the respective input points may be detected and adjusted only once every several frames in some embodiments.

In another embodiment, the detecting wire is not provided to the input path P1 of which the input point is the nearest to the power supply driver chip 20, and the voltage at the input point A1 of the input path P1 is equal to the input voltage PVDD1 supplied to the input path P1 by the power supply driver chip 20. Furthermore, the reference voltage P0 may also be equal to the input voltage PVDD1 supplied to the input path P1 by the power supply driver chip 20. Because the input point of the input path P1 is nearest to the power supply driver chip 20 and the length of the input path P1 is much smaller than those of other paths, the resistance R1 of the input path P1 is also the smallest and the voltage drop generated by the input path P1 is negligible. Therefore, the detecting wire may not be provided for the input path P1 and the input voltage PVDD 1 of the input path P1 may be used as the reference voltage. In such a design one detecting wire may be omitted, facilitating the wiring on the panel. Also, the comparison between the voltage at the input point of the input path P1 and the reference voltage is omitted, so the computation of the power supply driver chip is reduced and the power consumption is decreased.

Certainly, the voltage at the input point of any of the input paths may be served as the reference voltage P0. For example, the voltage at the input point A2 of the input path P2 or at the input point A3 of the input path P3 may be served as the reference voltage, and in this way, one comparison between the voltage at the input point of one input path and the reference voltage may be omitted, and the computation of the power supply driver chip is reduced.

In the second embodiment three input paths are provided; and in other embodiments depending on the size of the panel, two or more input paths can be selectively provided to supply input voltages for the pixel units.

Third Embodiment

Figure 6:
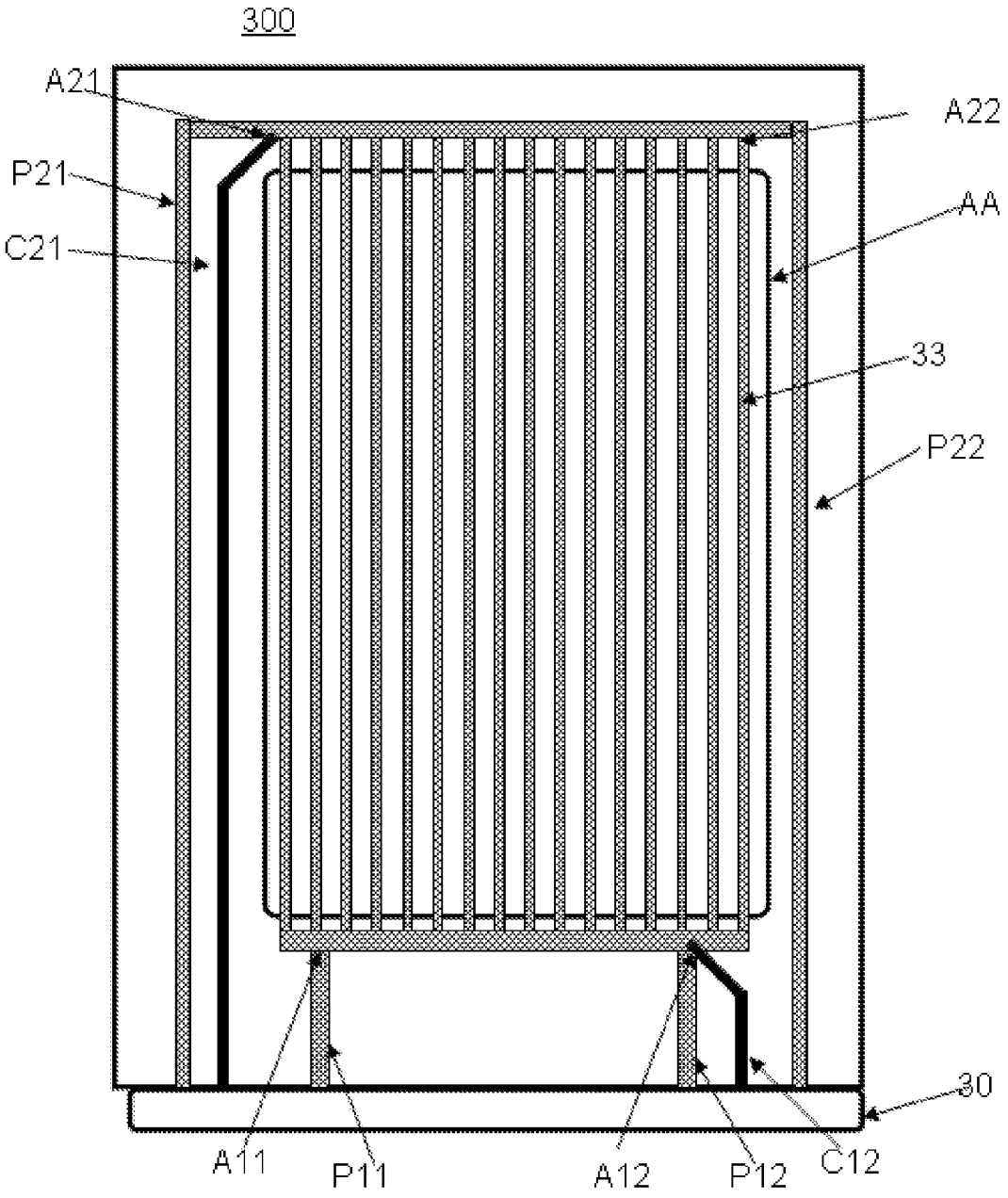
FIG. 6 is a schematic diagram of an OLED display device according to a third embodiment of the present invention.

Reference is made to FIG. 6, which is a schematic diagram of an OLED display device provided in a third embodiment. In the OLED display device 300 provided according to the third embodiment, multiple pixel units arranged in a matrix are disposed in a display region AA, and a power supply driver chip 30 is located at one side of the multiple pixel units. The power supply driver chip 30 is configured to supply input voltages to the multiple pixel units. The power supply driver chip 30 supplies input voltages to the multiple pixel units through two input paths P1 and P2 respectively. The input point of the input path P1 is located at the pixel unit which is the nearest to the power supply driver chip 30, and the input point of the input path P2 is located at the pixel unit which is the farthest to the power supply driver chip 30. At the respective one of the input points, the input path and the pixel unit are connected. In the third embodiment, input terminals for the input voltages of each column of the pixel units are connected with one wire 33, and all the wires 33 are connected together outside the display region AA.

The input path P1 includes two branches P11 and P12, which have the same length from the power supply driver chip 30 to the respective input points A11 and A12. The power supply driver chip 30 supplies equal input voltages to the branches P11 and P12. The branches P11 and P12 converge within the matrix of the pixel units, and the input point A11 of the branch P11 and input point A12 of the branch P12 are symmetrically disposed with respect to the center line of the matrix of the pixel units. In the third embodiment, the input point A11 of the branch P11 is located at the left side of the matrix of the pixel units and the input point A12 of the branch P12 is located at the right side of the matrix of the pixel units, and the input points A11 and A12 correspond to a same row of pixel units. A detecting wire C12 is disposed for the branch P12 to transfer the voltage at the input point A12 to a detecting point for detecting.

Similarly, the input path P2 includes two branches P21 and P22, which have the same length from the power supply driver chip 30 to the respective input points A21 and A22. The power supply driver chip 30 supplies equal input voltages to the branches P21 and P22. Furthermore, the input point A21 of the branch P21 and the input point A22 of the branch P22 are symmetrically disposed with respect to the center line of the matrix of the pixel units. A detecting wire C21 is disposed for the branch P21 to transfer the voltage at the input point A21 to a detecting point for detecting. The power supply driver chip 30 corrects the respective input voltages supplied to the respective input paths according to detection results, to ensure that the voltages at the respective input points of the input paths are substantially consistent.

Each of the input paths includes two symmetrical branches, and the power supply driver chip 30 corrects the respective input voltages supplied to the input paths according to the detection results, so the input voltages are more balanced and the brightness uniformity is better for the matrix of the pixel units.

Furthermore, since the two branches are symmetrical, the detecting wire is needed for only one of the two branches. The detecting wires for different input paths may be disposed on different sides, facilitating the structural design of the OLED display device 300.

In the second embodiment, the detecting point is disposed within the power supply driver chip, and the power supply driver chip may detect the voltages at the respective input points through the detecting point for every frame or every several frames, and then perform the compensation. The detection and compensation are performed continuously, and hence the method for detecting and compensating as described above can be regarded as a dynamic method.

In the third embodiment, all of the detecting points of the input paths are disposed on the panel of the OLED display device 300, and the detecting is performed during the procedure for producing the OLED display device 300. Specifically, in the module process for the OLED display device 300, input voltages PVDD1 and PVDD2 are firstly supplied to the branches P11 and P12 of the input path P1 and the branches P21 and P22 of the input path P2, respectively, in which the input voltage PVDD2 may be higher than or equal to the input voltage PVDD1. Then, an detecting apparatus may detect the voltages at the input points A12 and A21 through the detecting wires C12 and C21, respectively, and obtain respective compensation voltages after comparing the detected voltages with the reference voltage P0. For example, a compensation voltage for the input path P1 is ΔV1, and a compensation voltage for the input path P2 is ΔV2.

In the third embodiment, the method for determining a compensation voltage for each input path may be as follows. Firstly, multiple sets of compensation voltages are determined based on measurements performed on multiple images. For example, a set of compensation voltages is measured when the OLED display device 300 is in the brightest state, another set of compensation voltages is measured when the OLED display device 300 is in the darkest state, and so on. Then a middle value or an average value of the multiple sets of compensation voltages or another appropriate value is taken as a compensation voltage ΔV1, which may result in a best image display effect. Subsequently, a value obtained by adding the compensation voltage ΔV1 with the original input voltage PVDD1 is burned (programmed) into the power supply driver chip 30 of the type of OTP (One Time Programmable).

During the display process of the OLED display device 300, the power supply driver chip 30 supplies a corrected input voltage for each of input paths. For example, an input voltage supplied for the input path P1 is (PVDD1+ΔV1), and an input voltage supplied for the input path P2 is (PVDD2+ΔV2), to keep the voltages at the input points of the input paths P1 and P2 to be consistent, enabling the matrix of the pixel units to display with a uniform brightness.

In the third embodiment, the input voltage supplied to each of the input paths by the power supply driver chip 30 is corrected and the detecting is performed by an external apparatus during the producing procedure, so the above method for detecting and compensating as described above may be regarded as a static method. Compare with the dynamic method for detecting and compensating, in the static method for detecting and compensating the computation of the power supply driver chip 30 is reduced. Moreover, the static method for detecting and compensating may be applied to a batch production. Specifically, several OLED display devices are selected from a batch of OLED display devices as samples, for each of which, an appropriate compensation voltage ΔV for each of the input paths is determined based on a detection, and the sum of the compensation voltage ΔV and the input voltage supplied to the input path by the power supply driver chip during the detection is burned into the power supply driver chips of the batch of OLED display devices. For the batch production of the OLED display devices, convenient correction of the compensation voltages may be achieved with the static method for detecting and compensating, resulting in a higher operability and a lower cost.

Fourth Embodiment

Figure 7:
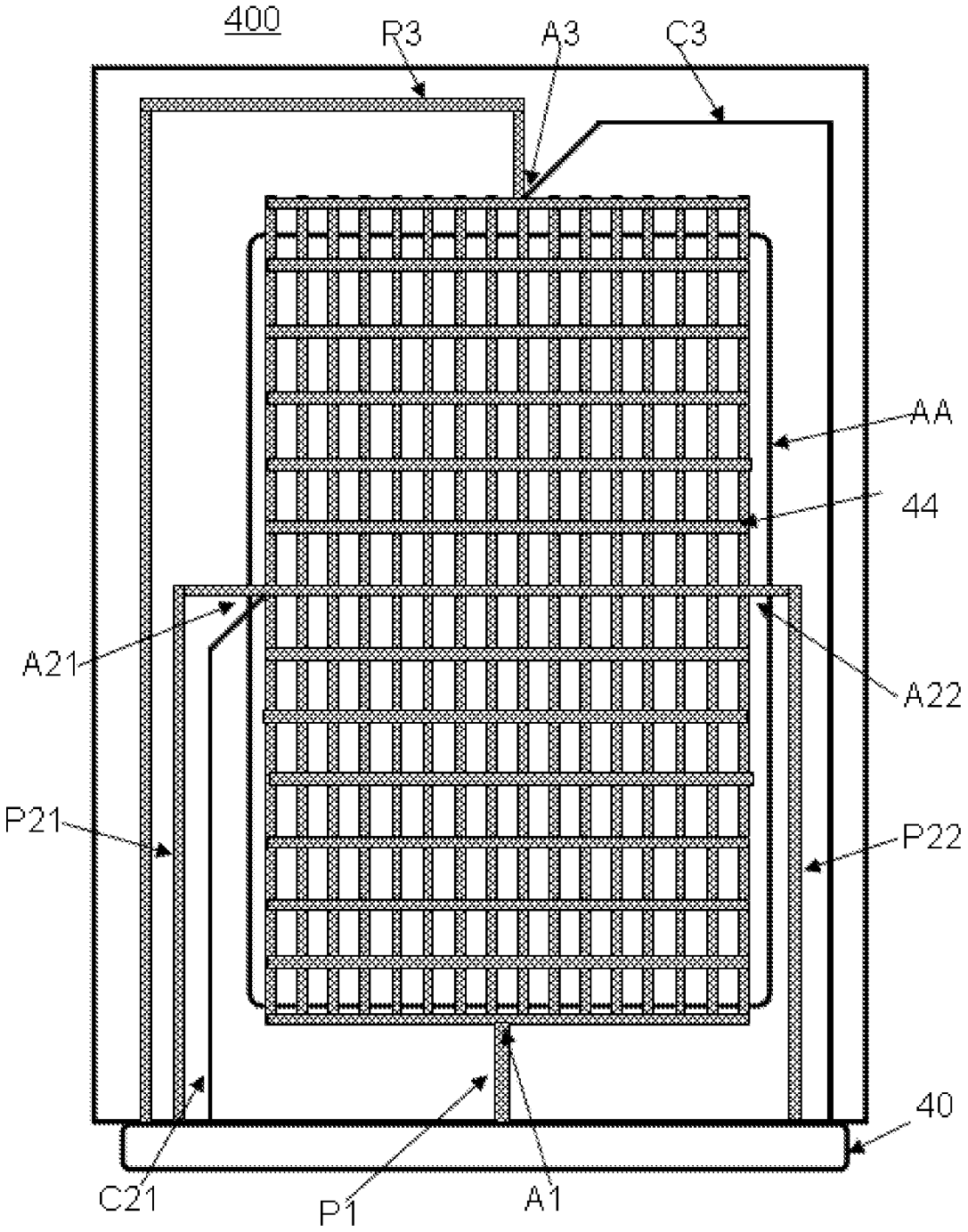
FIG. 7 is a schematic diagram of an OLED display device according to a fourth embodiment of the present invention.

Reference is made to FIG. 7, which is a schematic diagram of an OLED display device provided in a fourth embodiment. In an OLED display device 400 provided according to the fourth embodiment, multiple pixel units arranged in a matrix are disposed in a display region AA, and a power supply driver chip 40 is located at one side of the multiple pixel units. The power supply driver chip 40 is configured to supply input voltages PVDDs to the multiple pixel units. The power supply driver chip 40 supplies input voltages to the multiple pixel units through three input paths P1, P2 and P3 respectively. In the fourth embodiment, input terminals for the input voltages PVDDs of the pixel units are connected together within the display region AA, to form a net shaped wiring 44.

The three input paths P1, P2 and P3 are located at different sides of the matrix of the pixel unit. The input path P2 includes two branches P21 and P22, and the input point A21 of the branch P21 and the input point A22 of the branch P22 are symmetrically disposed with respect to the center line of the matrix of the pixel units. The OLED display device 400 further includes detecting wires C21 and C3, which respectively transfer voltages at the input point A21 and A3 to the power supply driver chip 40 for detection and compensation. The method for detecting and compensating is the same as that in the second embodiment, which will not be repeated herein.

In the fourth embodiment, the input paths P1, P3 and the two branches P21 and P22 of the input path P2 are distributed evenly with respect to the matrix of the pixel units, and therefore more stable input voltages may be supplied to the matrix of the pixel units.

In the OLED display device provided in the invention, the power supply driver chip supplies the input voltages to the matrix of the pixel units through two or more input paths, and the pixel units at different locations may have an approximately equal input voltage. Therefore, the problem that from the nearest side to the farthest side to the power supply driver chip voltages of the pixel units are sequentially reduced from one pixel unit to another is resolved, enabling the entire display region of the OLED display device to display with a uniform brightness and improving the display performance. Further, the OLED display device provided in the invention has the function of detecting and correcting the input voltages, and hence the voltages at the respective input points may be consistent or approximate. That is, for all of the pixel units in the entire display region AA, not only the input points are disposed evenly, but also the voltages at the respective input points are the same or approximate, which may further improve the brightness uniformity of the OLED display device.

Obviously, various modifications and variations may be made by those skilled in the art without departing from the spirit and scope of the present invention. Therefore, these modifications and variations made within the scope of the appending claims and the equivalent are intended to be included in the present invention.

What is claimed is:

1. An Organic Light-Emitting Diode display device, comprising:

a plurality of pixel units arranged in a matrix;

a power supply driver chip located at one side of the multiple pixel units and configured to supply input voltages to the multiple pixel units through a plurality of input paths, wherein the plurality of input paths are associated with input points each corresponding to a pixel unit at a different location;

a reference voltage; and a detecting wire associated with one of the input paths and configured to transfer a voltage at an associated input point to a detecting point for a comparison to the reference voltage, wherein if there is a voltage difference between the voltage at the associated input point and the reference voltage, the power supply driver chip supplies a compensation voltage to the one of the input paths to change the voltage, so as to reduce the voltage difference, wherein the power supply driver chip supplies a negative compensation voltage to an input path for which the voltage at the input point is higher than the reference voltage to reduce the input voltage of the input path, so as to reduce the voltage difference; or the power supply driver chip is configured to supply a positive compensation voltage to an input path for which the voltage at the input point is lower than the reference voltage to increase the input voltage of the input path, so as to reduce the voltage difference.

2. The Organic Light-Emitting Diode display device according to claim 1, wherein the reference voltage is equal to an input voltage supplied to an input path of which an associated input point is the nearest to the power supply driver chip, or the reference voltage is equal to a voltage at an input point of any one of the input paths.

3. The Organic Light-Emitting Diode display device according to claim 1, wherein the detecting wire is not provided to an input path of which an associated input point is the nearest to the power supply driver chip, and the voltage at the associated input point of the input path is equal to the input voltage supplied to the input path by the power supply driver chip.

4. The Organic Light-Emitting Diode display device according to claim 1, wherein the input points of the plurality of input paths are distributed evenly with respect to the matrix of the pixel units.

5. The Organic Light-Emitting Diode display device according to claim 4, wherein the input points of the plurality of input paths are disposed on a same side of the matrix of the pixel units and spaced apart by an equal number of rows of pixel units.

6. The Organic Light-Emitting Diode display device according to claim 4, wherein the input path comprises two branches having an equal path length and being supplied with an equal input voltage by the power supply driver chip, the two branches having input points symmetrically disposed with respect to the center line of the matrix of the pixel units.

7. The Organic Light-Emitting Diode display device according to claim 6, wherein an input point of the two branches is connected to a detecting point through a detecting wire.

8. The Organic Light-Emitting Diode display device according to claim 4, wherein the input points of the plurality of input paths are disposed on different sides of the matrix of the pixel units, and the input points are disposed in a left-right symmetry or in a top-bottom symmetry.

9. The Organic Light-Emitting Diode display device according to claim 1, wherein the detecting point is located inside the power supply driver chip and the comparison between the voltage at the input point and the reference voltage is performed by the power supply driver chip; or the detecting point is located at a panel and the comparison between the voltage at the input point and the reference voltage is performed by an external detecting apparatus.

* * * * *